US007677304B1

(12) United States Patent
Smith

(10) Patent No.: US 7,677,304 B1
(45) Date of Patent: Mar. 16, 2010

(54) PASSABLE NO-GO DEVICE FOR DOWNHOLE VALVE

(75) Inventor: Roddie R. Smith, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 11 days.

(21) Appl. No.: 12/200,463

(22) Filed: Aug. 28, 2008

(51) Int. Cl.
*E21B 23/00* (2006.01)

(52) U.S. Cl. ..... 166/237; 166/319; 166/238

(58) Field of Classification Search ..... 166/237, 166/319, 238, 381, 382, 386
See application file for complete search history.

(56) References Cited

U.S. PATENT DOCUMENTS 4,339,001 A * 7/1982 Paschal, Jr. ..... 166/322
4,520,870 A * 6/1985 Pringle ..... 166/317
4,574,883 A * 3/1986 Carroll et al. ..... 166/255.1
7,455,116 B2 * 11/2008 Lembcke et al. ..... 166/374

OTHER PUBLICATIONS

Weatherford, "7-in. Completion Isolation Valve (CIV/S) with stinger in three positions," dated Feb. 15, 2001.

Weatherford, "9-⅝-in. Completion Isolation Valve (CIV/S)," undated.

Graham Makin, "Completion valves continue evolution," Hart's E&P, p. 57-58, dated May 2001.

* cited by examiner

*Primary Examiner*—David J Bagnell
*Assistant Examiner*—James G Sayre
(74) *Attorney, Agent, or Firm*—Wong, Cabello, Lutsch, Rutherford Brucculeri, LLP

(57) ABSTRACT

A downhole valve has a flow tube hydraulically actuated to open and close a flapper. The flow tube moved to a first position closes the flapper to restrict flow through the valve. The flow tube moved to a second position opens the flapper. A passable no-go device disposed in the valve permits or restricts mechanical passage through the valve in response to the position of the flow tube. The apparatus has a support and one or more dogs supported in windows of the support and biased by springs. The flow tube in the first position pushes the dogs to an extended position that restricts mechanical passage through valve so that a tool cannot be passed through the valve while the flapper is closed. When the flow tube is in the second position, however, the dogs retract so the tool can be passed through the valve while the flapper is open.

20 Claims, 4 Drawing Sheets

PASSABLE NO-GO DEVICE FOR DOWNHOLE VALVE

BACKGROUND

Flapper valves and other types of downhole valves can be damaged if a tool string is allowed to pass through them when they are in the closed condition. For example, the tool string run through the valve can damage the valve's flapper when closed. Also, the tool string even if capable of passing through the closed flapper may not be allowed to pass back up through the flapper so that the tool sting becomes trapped by the valve.

From the surface, operators do not always know if the flapper in these type of valves is open or not. Typically, operators must run a wireline drift tool through the valve to determine if the flapper is open or closed. If the flapper is open, then the drift tool is able to pass through. If the flapper is closed, the drift tool will stick through the flapper which then activates an artificial hold open sleeve to allow for the drift tool to be retrieved. Another way operators can determine whether a flapper is open or closed involves running a camera downhole and feeding back images to the surface.

Sometimes, a downhole valve may have dogs that engage a specifically designed stringer used to open and close the valve. For example, Weatherford's completion isolation valve (CIV) is a ball type valve actuated by a stinger. Dogs in the CIV engage the stinger and allow the stinger to move internal components to open and close the valve's ball seal. In this instance, these dogs move with the internal components of the valve that operate the ball seal. Therefore, these dogs are directly used to operate the valve by engaging the stinger and not to passively prevent a generic type of tool from being passed through the valve when closed.

What is needed is a way to reliably and easily prevent potential damage to a downhole valve by a generic tool string and to prevent entrapment of the tool string in the valve by passively preventing mechanical passage of the tool string in the valve when closed.

DETAILED DESCRIPTION

Figure 1A:
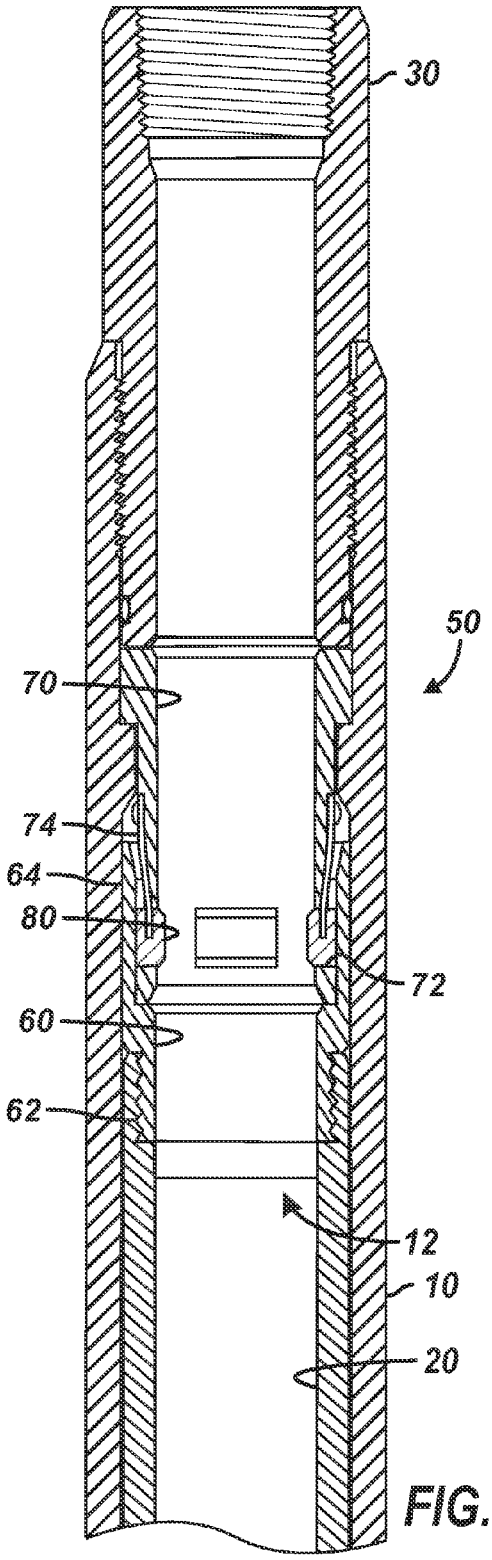
FIG. 1A illustrates a passable no-go device for a downhole flow control tool in a no-go condition.

A passable no-go device 50 illustrated in FIG. 1A is used with a downhole flow control tool having a housing 10 and an actuator 20. The flow control tool can be a downhole valve, and the actuator 20 can a flow tube hydraulically actuated between first and second positions to control fluid flow through the housing 10 by actuating a flapper (not shown) in the tool. The device 50 includes an activation member 60, a support 70, and dogs 80. The support 70 fits into the housing's flow passage 12, and an end piece 30 fits on the end of the housing 10 and holds the support 70 therein. The support 70 has windows 72 that hold the dogs 80 therein. The dogs 80 are movable into and out of the windows 72 relative to the housing's flow passage 12, and springs 74 connect the dogs 80 to the support 70 and bias the dogs 80 to a retracted position in the windows 72.

As shown in FIG. 1A, the activation member 60 attaches to a distal end of the actuator 20 (e.g., flow tube) by threads 62, although other forms of affixing the member 60 to the flow tube 20 can be used. The member 60 has a distal lip 64 that is passable in a space behind the dogs 80 to force the dogs 80 to a no-go condition through the windows 72. In this no-go condition as shown, the dogs 80 extend partially into the housing's flow passage 12. To prevent the dogs 80 from passing completely through the windows 72, the dogs 80 can have ledges or shoulders (not shown) along their back edges that engage sides of the windows 72. Preferably, the lip 64 has a smaller inner diameter to fit in the space behind the support 70. Also, the support 70 preferably has the same diameter bore as the tool's flow passage 12 so that as little flow restriction occurs as possible.

Figure 1B:
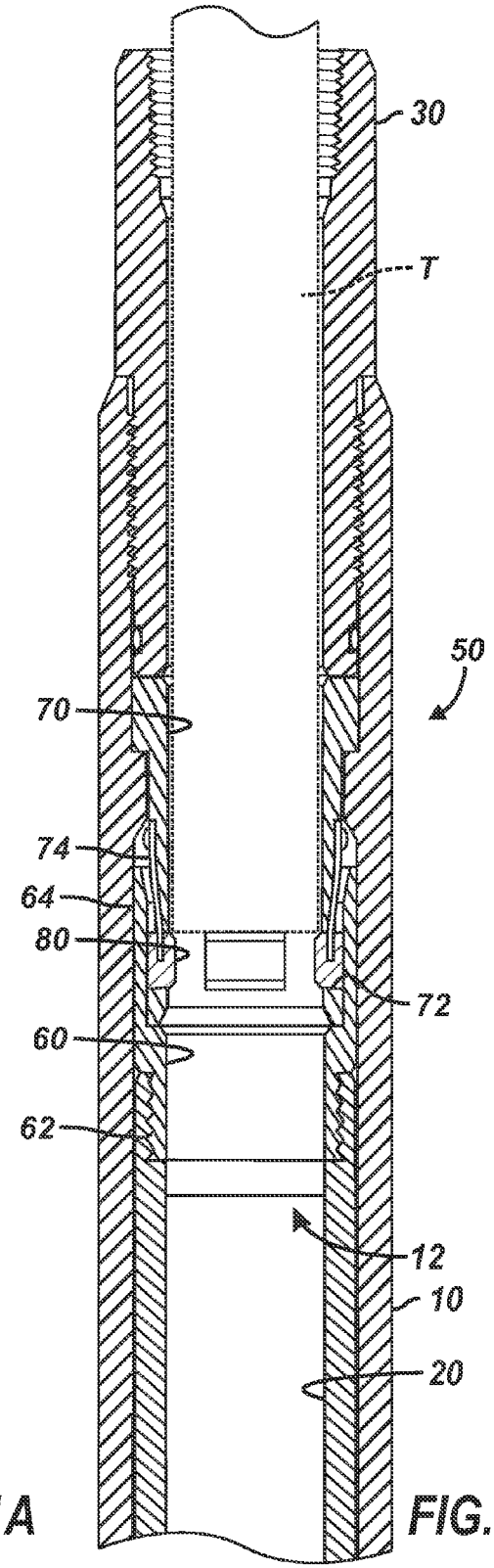
FIG. 1B illustrates the passable no-go device in the no-go condition preventing a tool string from passing into the downhole flow control tool.

As shown in FIG. 1B, the extended dogs 80 inhibit or restrict a tool string T attempting to pass through the device 50 in the housing's flow passage 12 while the lip 64 on the flow tube 20 forces the dogs 80 into their no-go condition. As discussed below, this no-go condition may occur when the flow tube 20 is moved into a first (uppermost) position in the tool's housing 10, for example, when a hydraulically activated flapper valve is closed.

Figure 2A:
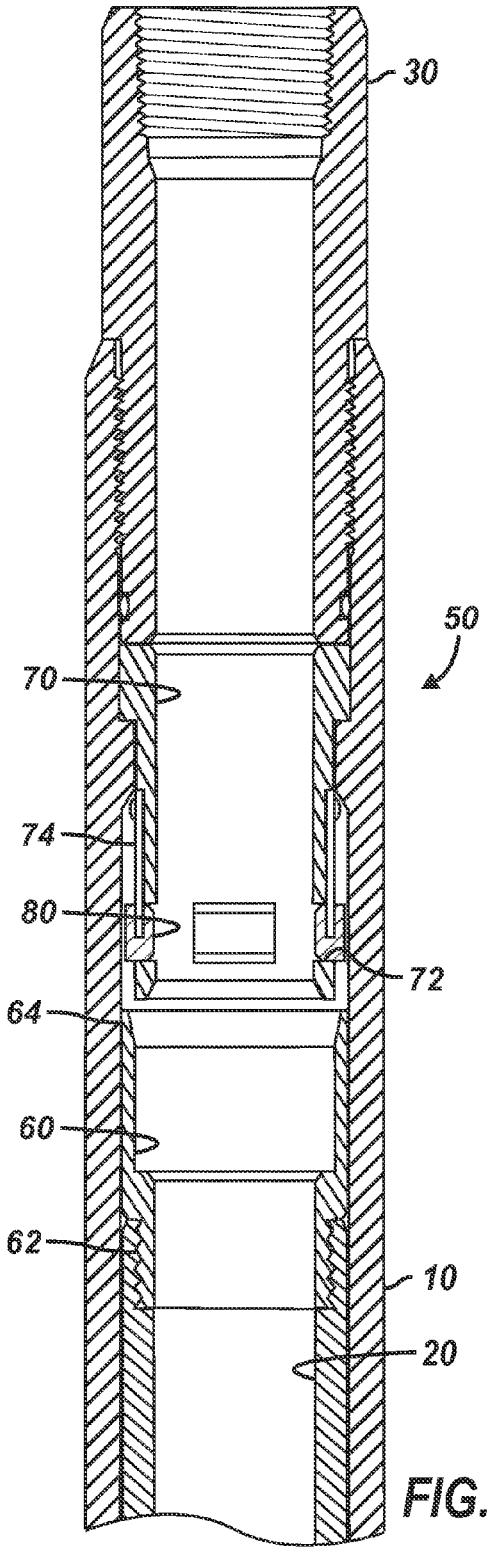
FIG. 2A illustrates the passable no-go device in a passable condition.
Figure 2B:
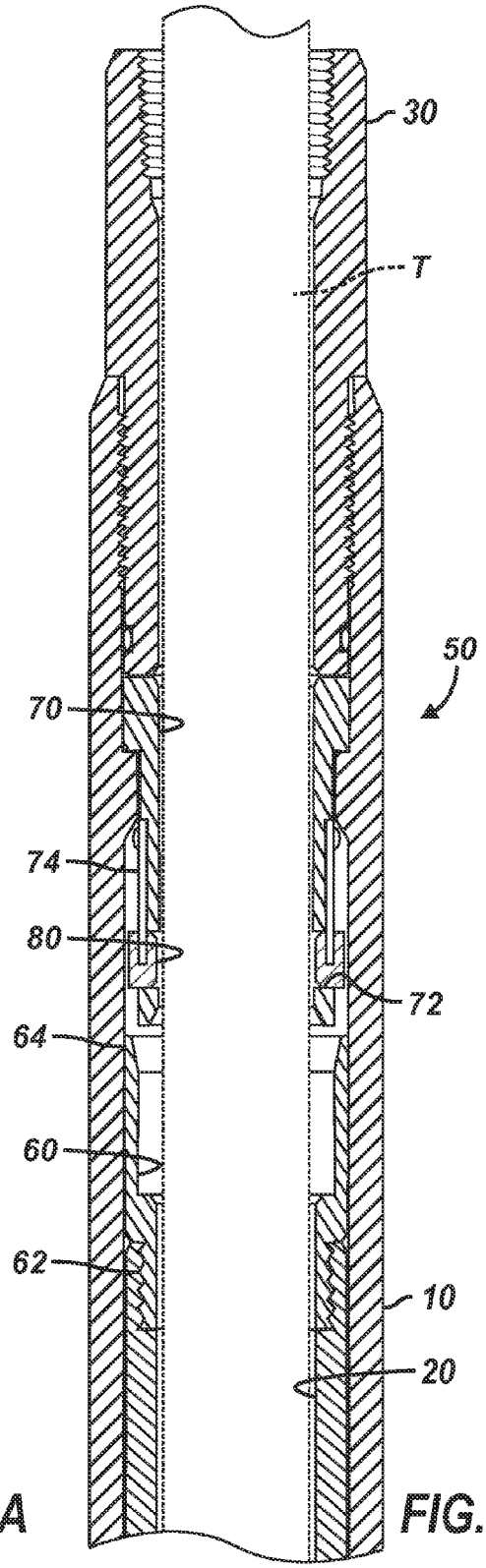
FIG. 2B illustrates the passable no-go device in the passable condition allowing a tool string to pass into the downhole flow control tool.

As shown in FIG. 2A, the passable no-go device 50 has a passable condition when the activation member 60 on the flow tube 20 is moved away from the support 70. In this condition, the lip 64 is removed from the space around the support 70, and the springs 74 bias the dogs 80 out of the support's windows 72. Therefore, the dogs 80 are allowed to move into the free space around the support 70. In this passable condition, a tool string T is mechanically uninhibited or unrestricted by the dogs 80 as the tool string T passes through the tool's housing 10 as shown in FIG. 2B. As discussed below, this passable condition may occur when the flow tube 20 is moved into a second (lower) position in the tool's housing 10, for example, when a hydraulically activated flapper valve is opened.

In addition to preventing a tool string T from passing through a closed flow control tool, the passable no-go device 50 may advantageously prevent (full) closure of the downhole flow control tool when the tool string T is positioned through the opened tool. When the tool is open as shown in FIG. 2B with the tool string T passing through, the retracted dogs 80 positioned in the space around the support 70 can stop the upward movement of the flow tube 20 by engaging the lip 64. Even though the lip 64 is made to fit behind and push the dogs 80 and may have a beveled edge, the dogs 80 may be prevented from extending through the windows 72 by engaging the profile of the tool string T passing through the flow passage 12. In this way, the lip 64 and flow tube 20 are not allowed to reach their uppermost position because the dogs 80 cannot extend. This can prevent full closure of the flow control tool and can prevent some forms of damage to the tool.

Figure 3A:
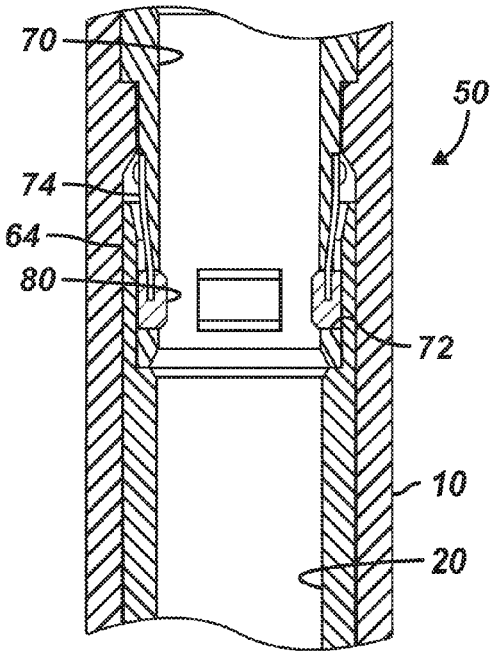
FIGS. 3A-3B show an alternative arrangement between the tool's flow tube and the passable no-go device.
Figure 3B:
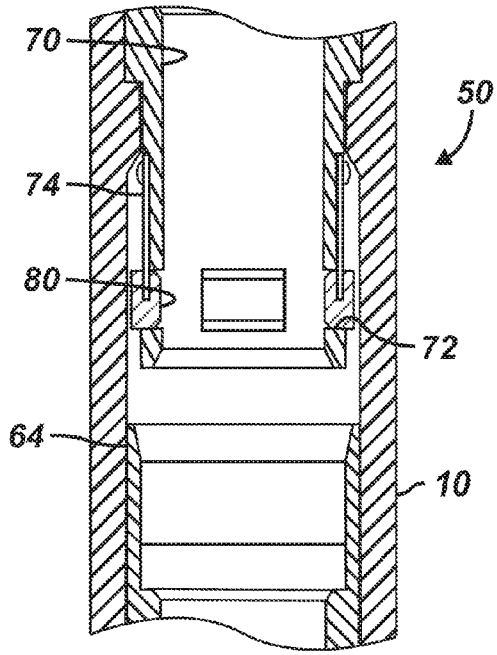
Figure 3C:
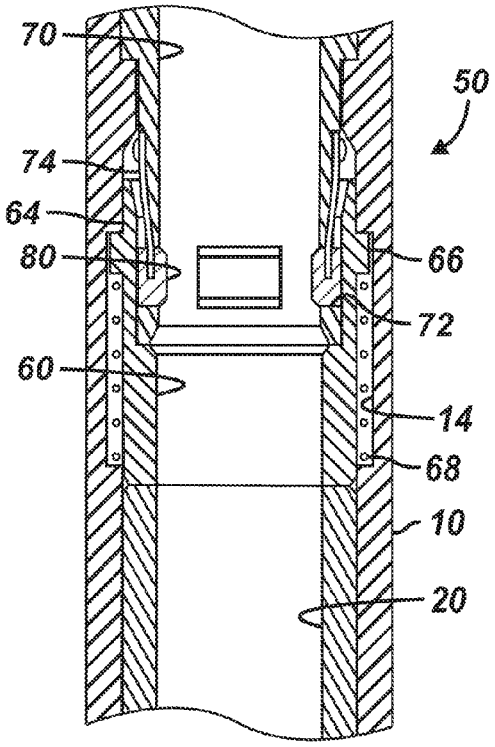
FIGS. 3C-3D show another alternative arrangement between the tool's flow tube and the passable no-go device.
Figure 3D:
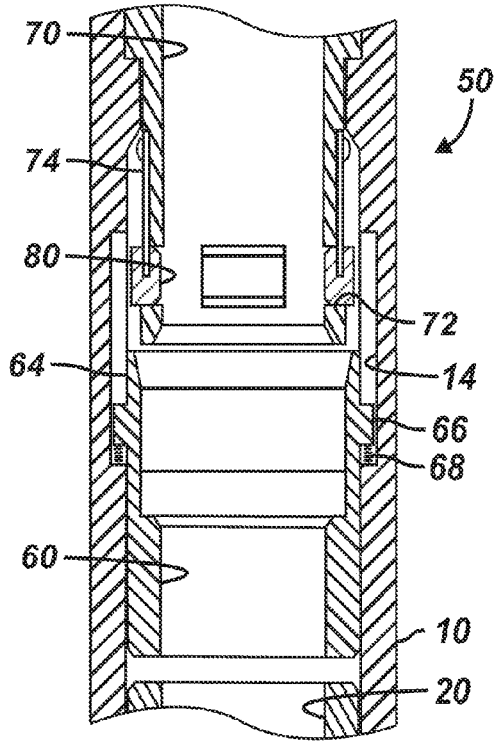

Although the activation member 60 is shown as a separate component from the flow tube 20 in FIGS. 1A through 2B, the features of the lip 64 can be integrally formed with the flow tube 20. As shown in FIGS. 3A-3B, for example, the lip 64 can be integrally formed on the end of the flow tube 20 and can operate in the same way discussed above to move behind and away from the space around the support to move the dogs 80. In another alternative shown in FIGS. 3C-3D, the lip 64 can be part of an independent activation member 60 unattached to the flow tube 20. In this way, abutting engagement of the flow tube 20 with the activation member 60 can move the lip 64 in the space behind the support 70. In this arrangement, the member 60 may have ridges 66 or the like that are held within slots 14 defined in the housing's flow passage 12 to guide the member's movement. In addition, the member 60 may be biased away from the support 70 by one or more springs 68 (shown here as extension springs) when the flow tube 20 is moved away from the member 60.

The passable no-go device 50 can be used with any downhole flow control tool that controls fluid flow therethrough but must also allow tool strings to pass through the tool when opened. Some suitable downhole flow control tools for use with the passable no-go device 50 include safety valves, downhole control valves, downhole deployment valves, fluid loss valves, and the like.

Figure 4A:
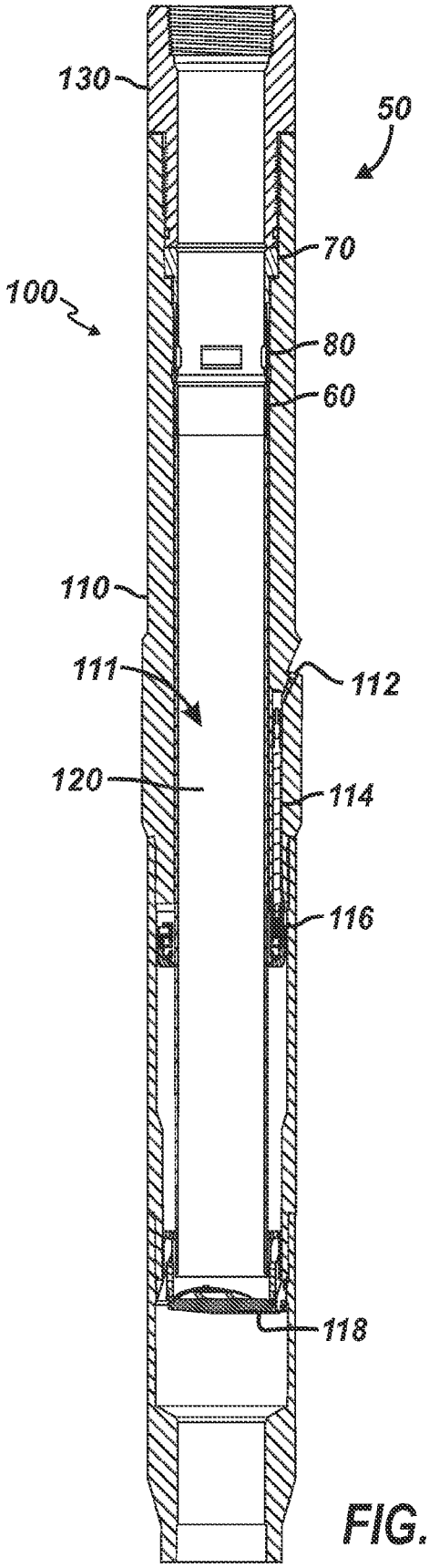
FIG. 4A illustrates the passable no-go device in the no-go condition used on a hydraulically actuated flapper valve when closed.
Figure 4B:
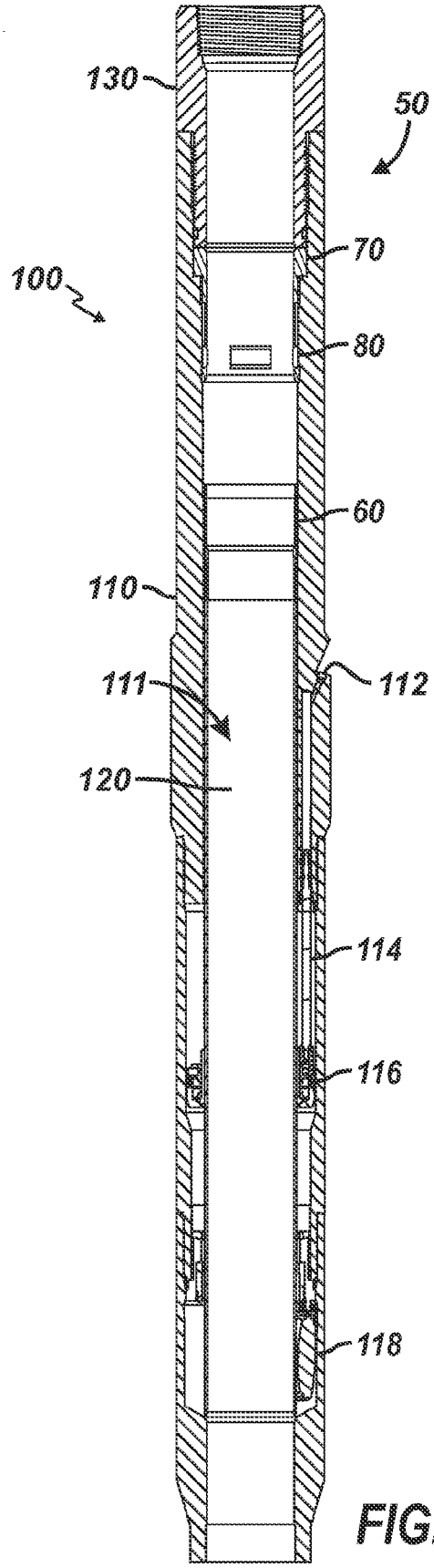
FIG. 4B illustrates the passable no-go device in the passable condition used on the hydraulically actuated flapper valve when opened.

As shown in FIGS. 4A-4B, for example, the passable no-go device 50 is shown used with a hydraulically actuated flapper valve 100. In this example, the valve 100 has a housing 110 with a flow passage 111. In the valve 100, a flow tube 120 in the flow passage 111 acts as an actuator and is hydraulically actuated between first and second conditions. A flapper 118 acts as a closure member for the flow passage 110 and is mechanically operated between opened and closed conditions by the flow tube 120.

In operation, the absence of hydraulic pressure at a hydraulic port 112 allows the flapper 118 to pivot closed and restrict fluid flow through the valve 100 as shown in FIG. 4A. When hydraulic pressure is applied as shown in FIG. 4B, the hydraulic control fluid communicated through the port 112 actuates a piston 114 connected to the flow tube 120 by a coupling 116. The hydraulically actuated piston 114 thereby moves the flow tube 120 downward in the housing 110 to open the flapper 118 and permit fluid flow through the valve 100. A spring (not shown) may be provided in the space around the flow tube 120 to bias the flow tube 120 to its uppermost position so that the flapper 118 is biased closed.

When the flapper 118 is closed as shown in FIG. 4A, it is preferred that a tool string is not allowed to pass through the valve 100 because the tool string could damage the closed flapper 118. Even if a tool string were allowed to pass the closed flapper 118, operators may not be able to back out the tool string because the flapper 118 may catch on portions of the tool string preventing its retrieval from the valve. To overcome these problems, the passable no-go device 50 installed as part of the flapper valve 100 passively reacts to the opened or closed condition of the valve 100 to either permit or restrict mechanical passage of a tool string through the valve 100.

To do this, the passable no-go device 50 prevents the tool string from reaching the flapper 118 when closed by tying its operation to the independent operation of the flapper valve 100, which is hydraulically actuated by separate means. In other words, the passable no-go device 50 acts as a restricting member mechanically operated by the flow tube 120 and responds to the closing of the flapper 118 by the upward moving flow tube 120 so that the dogs 80 extend and prevent mechanical passage of the tool string through the valve 100. As shown in FIG. 4A, the flapper 118 is closed because the flow tube 120 is moved to its uppermost position in the housing 100. The activation member 60 moved by the flow tube 120 fits behind the support 70 and pushes the dogs 80 into the valve's flow passage 111. In this restrictive no-go condition, the device 50 at least partially restricts mechanical passage through the flow passage 111 because the dogs 80 can mechanically restrict a tool string from getting to the flapper 118 while closed.

On the other hand, the passable no-go device 50 responds to the opening of the flapper 118 by the downward movement of the flow tube 120 when the valve 100 is opened so that the dogs 80 retract and allow mechanical passage of the tool string through the valve 100. As shown in FIG. 4B, the flapper 118 is opened because the flow tube 120 has been hydraulically moved to its lowermost position in the housing 100. The activation member 60 on the upper end of the flow tube 120 is moved away from the support 70 and allows the dogs 80 to retract from the valve's passage 111. In this unrestrictive passable condition, the dogs 80 will not restrict a tool string from passing through the valve 100, removes the mechanical restriction through the valve 100.

As will be appreciated, the passable no-go device 50 eliminates the need for an initial discovery run with a camera or a drift tool to be performed to determine if the flapper 118 is first open before running a tool string through the flapper valve 100. Instead, the tool string can be run down hole. If the valve 100 is inadvertently left closed or is inoperable for some reason, then the passable no-go device 50 can prevent further passage of the tool string to the valve 100. This can speed up running in and out of the wellbore and can reliably reduce the potential of damage to the flapper 118 or a stuck tool string.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole flow control tool, comprising:

a housing having a flow passage;

an actuator movably disposed in the housing and being actuatatable between first and second conditions;

a closure member movably disposed in the flow passage and operated by the actuator, the closure member having a closed condition at least partially restricting fluid flow through the flow passage in response to the actuator having the first condition, the closure member having an opened condition removing the flow restriction in response to the actuator having the second condition; and a restricting member axially fixed in the flow passage, at least a portion of the restricting member being laterally movable in the flow passage and being passively operated by the actuator, the restricting member having a restrictive condition at least partially restricting mechanical passage through the flow passage in response to the actuator having the first condition, the restricting member having an unrestrictive condition removing the mechanical restriction in response to the actuator having the second condition.

2. The tool of claim 1, wherein the downhole flow control tool comprises a downhole valve.

3. The tool of claim 2, wherein the closure member comprises a flapper rotatably connected to the housing.

4. The tool of claim 1, wherein the restricting member comprises one or more dogs movable between extended and retracted positions in response to the movement of the actuator, the one or more dogs in the extended position at least partially restricting the flow passage, the one or more dogs in the retracted position removing the restriction.

5. The tool of claim 4, wherein the restricting member comprises a support disposed in the flow passage and having one or more windows, the support supporting the one or more dogs movably disposed in the one or more windows.

6. The tool of claim 5, wherein an activation member movable by the actuator is positionable between the support and the housing, whereby the activation member positioned between the support and the housing extends the one or more dogs through the windows and at least partially into the flow passage, and whereby the activation member positioned away from the support permits the one or more dogs to retract in the one or more windows.

7. The tool of claim 6, wherein the activation member comprises a lip integrally formed on the actuator.

8. The tool of claim 6, wherein the activation member comprises a lip affixed to and movable with the actuator.

9. The tool of claim 6, wherein the activation member comprises a lip independent of the actuator and movable by engagement with the actuator.

10. The tool of claim 5, wherein one or more springs bias the one or more dogs to the retracted position.

11. A downhole valve, comprising:

a housing having a flow passage;

a flow tube movably disposed in the flow passage and being hydraulically movable between first and second positions;

a closure member movably disposed in the flow passage and mechanically operated by the flow tube, the closure member having a closed condition at least partially restricting fluid flow through the flow passage in response to the flow tube having the first position, the closure member having an opened condition removing the flow restriction in response to the flow tube having the second position; and one or more dogs axially fixed in the flow passage, the one or more dogs being laterally movable in the flow passage and passively operated by the flow tube, the one or more dogs having an extended position at least partially restricting mechanical passage through the flow passage in response to the flow tube having the first position, the one or more dogs having a retracted position removing the mechanical restriction in response to the flow tube having the second position.

12. The valve of claim 11, wherein the closure member comprises a flapper rotatably connected to the housing.

13. The valve of claim 11, wherein the housing comprises a support disposed in the flow passage and having one or more windows, the support supporting the one or more dogs movably disposed in the one or more windows.

14. The valve of claim 13, wherein a member movable by the flow tube is positionable between the support and the housing, whereby the member positioned between the support and the housing extends the one or more dogs through the windows and at least partially into the flow passage, and whereby the member positioned away from the support permits the one or more dogs to retract in the one or more windows.

15. The valve of claim 14, wherein the member comprises a lip integrally formed on the flow tube.

16. The valve of claim 14, wherein the member comprises a lip affixed to and movable with the flow tube.

17. The valve of claim 14, wherein the member comprises a lip independent of the flow tube and movable by engagement with the flow tube.

18. The valve of claim 11, wherein one or more springs bias the one or more dogs to the retracted position.

19. A passable no-go apparatus for a downhole flow control tool, comprising:

a support axially fixable in a flow passage of a downhole flow control tool, the support defining a space between an outer surface of the support and the flow passage, the support defining one or more windows communicating the space with an interior passage through the support; and one or more dogs disposable in the one or more windows of the support, the one or more dogs being laterally movable between extended and retracted positions in the one or more windows of the support, the one or more dogs in the extended position extending at least partially into the interior passage of the support, and one or more dogs in the retracted position retracted from the interior passage, wherein the one or more dogs are movable by passive interaction with a portion of the downhole flow control tool that is independently movable in the space between the support and the flow passage.

20. A downhole apparatus, comprising:

a housing having a flow passage;

means for hydraulically actuating between first and second mechanical conditions;

means for at least partially restricting fluid flow through the flow passage in response to the first mechanical condition and for permitting fluid flow through the flow passage in response to the second mechanical condition;

means fixed axially in the flow passage for at least partially restricting mechanical passage through the flow passage passively in response to the first mechanical condition and for permitting mechanical passage through the flow passage passively in response to the second mechanical condition.

* * * * *